US012359846B2

(12) United States Patent
Jayarathne et al.

(10) Patent No.: US 12,359,846 B2
(45) Date of Patent: Jul. 15, 2025

(54) SYSTEMS AND METHODS FOR OPERATING A FURNACE SYSTEM

(71) Applicant: Johnson Controls Tyco IP Holdings LLP, Milwaukee, WI (US)

(72) Inventors: Madhuka Manuranga Jayarathne, Wichita, KS (US); Daniel W. Davis, II, Wichita, KS (US); Frank D. Ashby, Wichita, KS (US)

(73) Assignee: JOHNSON CONTROLS LIGHT COMMERCIAL IP GMBH, Neuhausen am Rheinfall (CH)

( * ) Notice: Subject to any disclaimer, the term of this patent is extended or adjusted under 35 U.S.C. 154(b) by 20 days.

(21) Appl. No.: 17/512,481

(22) Filed: Oct. 27, 2021

(65) Prior Publication Data

US 2022/0136736 A1 May 5, 2022

Related U.S. Application Data

(60) Provisional application No. 63/107,331, filed on Oct. 29, 2020.

(51) Int. Cl.
*F24H 9/20* (2022.01)
*F23N 1/06* (2006.01)
(Continued)

(52) U.S. Cl.
CPC ..... *F24H 9/2085* (2013.01); *F23N 1/062* (2013.01); *F23N 5/242* (2013.01); *F24H 3/006* (2013.01);
(Continued)

(58) Field of Classification Search
CPC ..... F23D 14/02; F23N 1/062; F23N 5/022; F23N 5/16; F23N 5/242; F23N 2225/04;
(Continued)

(56) References Cited

U.S. PATENT DOCUMENTS 4,591,331 A 5/1986 Moore
5,630,408 A 5/1997 Versluis
(Continued)

FOREIGN PATENT DOCUMENTS

CA 2957726 A1 3/2016
CA 3043996 A1 2/2018
(Continued)

OTHER PUBLICATIONS

EP-3260777-A1—Translation (Year: 2017).*
(Continued)

*Primary Examiner* — Steven B McAllister
*Assistant Examiner* — Benjamin W Johnson
(74) *Attorney, Agent, or Firm* — Fletcher Yoder, P.C.

(57) ABSTRACT

A furnace system includes a heat exchanger and a burner assembly including a burner enclosure fluidly coupled to the heat exchanger. The burner assembly is configured to receive a fluid, ignite the fluid to produce combustion byproducts, and direct the combustion byproducts to the heat exchanger. The furnace system also includes a pressure sensor configured to detect a pressure within the burner enclosure. The furnace system is configured to operate based on the pressure detected by the pressure sensor.

15 Claims, 8 Drawing Sheets

(51) Int. Cl.

| | |
|---|---|
| ***F23N 5/24*** | (2006.01) |
| ***F24H 3/00*** | (2022.01) |
| *F23D 14/02* | (2006.01) |
| *F23N 5/02* | (2006.01) |
| *F23N 5/16* | (2006.01) |
| *F24H 15/112* | (2022.01) |
| *F24H 15/116* | (2022.01) |

(52) U.S. Cl.
CPC ..... *F23D 14/02* (2013.01); *F23N 5/022* (2013.01); *F23N 5/16* (2013.01); *F23N 2225/04* (2020.01); *F23N 2229/00* (2020.01); *F23N 2235/16* (2020.01); *F23N 2241/02* (2020.01); *F24H 15/112* (2022.01); *F24H 15/116* (2022.01)

(58) Field of Classification Search
CPC ..... F23N 2229/00; F23N 2235/16; F23N 2241/02; F24H 3/006; F24H 9/2085; F24H 15/112; F24H 15/116
USPC ..... 431/19
See application file for complete search history.

(56) References Cited

U.S. PATENT DOCUMENTS

| | | | | |
|---|---|---|---|---|
| 6,213,758 | B1 * | 4/2001 | Tesar | F23N 1/022 431/89 |
| 9,447,985 | B2 | 9/2016 | Johnson | |
| 9,845,954 | B2 * | 12/2017 | Wakabayashi | F23N 5/184 |
| 10,871,756 | B2 | 12/2020 | Johnson et al. | |
| 10,908,578 | B2 | 2/2021 | Johnson et al. | |
| 10,921,768 | B2 | 2/2021 | Johnson et al. | |
| 11,156,978 | B2 | 10/2021 | Johnson et al. | |
| 2016/0025374 | A1 * | 1/2016 | Karkow | F23D 14/02 122/18.31 |
| 2020/0096196 | A1 * | 3/2020 | Feldman | F23N 5/184 |
| 2020/0149780 | A1 * | 5/2020 | Chase | F24H 3/065 |

FOREIGN PATENT DOCUMENTS

| | | | | |
|---|---|---|---|---|
| EP | 3 186 687 | A4 | 7/2017 | |
| EP | 3260777 | A1 * | 12/2017 | F23N 5/242 |
| EP | 3 497 377 | A1 | 6/2019 | |

OTHER PUBLICATIONS

CoolingLogic, "CoolingLogic: Up early, saving billions." URL: http://coolinglogic.com/documents/MarketingFlyer_FINAL_HiRes8.5x11.pdf, retrieved from internet Oct. 27, 2022 (1 page).

Incomplete File of Communication with Various Companies, etc. in 2016-2021, URL: http://coolinglogic.com/documents/22072101_Letters_and_Signature_Receipts.pdf, published, as one document, on: Jul. 21, 2022 (211 pages).

Johnson Heating and Cooling L.L.C., "Divine Grace Building Automation (Images)," URL: http://cooljohnson.com/Building-Automation-Systems-Michigan/Oakland-County-Michigan/Building-Automation-Images.html, retrieved from internet Oct. 27, 2022 (8 pages).

Johnson Heating and Cooling L.L.C., "Divine Grace Building Automation," URL: http://cooljohnson.com/Building-Automation-Systems-Michigan/Oakland-County-Michigan/Building-Automation-Divine-Grace.html, retrieved from internet Oct. 27, 2022 (3 pages).

Johnson Heating and Cooling L.L.C., "Excel Rehabilitation Building Automation," URL: http://cooljohnson.com/Building-Automation-Systems-Michigan/Waterford-Michigan/Building-Automation-System--Excel.html, retrieved from internet Oct. 27, 2022 (2 pages).

Johnson Heating and Cooling L.L.C., "Intertek Testing Services Building Automation," URL: http://cooljohnson.com/Building-Automation-Systems-Michigan/Plymouth-Michigan/Building-Automation-System-Plymouth-Michigan.html, retrieved from internet Oct. 27, 2022 (8 pages).

Johnson Heating and Cooling L.L.C., "JLA Medical Building Building Automation," URL: http://cooljohnson.com/Building-Automation-Systems-Michigan/Waterford-Michigan/Building-Automation-System--JLA.html, retrieved from internet Oct. 27, 2022 (3 pages).

Johnson Heating and Cooling L.L.C., "Mosaic Christian Building Automation (Images)," URL: http://cooljohnson.com/Building-Automation-Systems-Michigan/Detroit/Building-Automation-Images.html, retrieved from internet Oct. 27, 2022 (12 pages).

Johnson Heating and Cooling L.L.C., "Mosaic Christian Building Automation," URL: http://cooljohnson.com/Building-Automation-Systems-Michigan/Detroit/Mosaic-Christian.html, retrieved from internet Oct. 27, 2022 (5 pages).

Johnson Heating and Cooling L.L.C., "Shepherd's Gate Lutheran Church Building Automation," URL: http://cooljohnson.com/Building-Automation-Systems-Michigan/Shelby-Township-Michigan/Building-Automation-Systems-SG.html, retrieved from internet Oct. 27, 2022 (3 pages).

Johnson Heating and Cooling L.L.C., "St. Clair County Residence Building Automation," URL: http://cooljohnson.com/Building-Automation-Systems-Michigan/St-Clair-Michigan/Building-Automation-System-St-Clair-Michigan.html, retrieved from internet Oct. 27, 2022 (4 pages).

Johnson Heating and Cooling L.L.C., "St. Joseph Mercy Oakland U. C. Building Automation," URL: http://cooljohnson.com/Building-Automation-Systems-Michigan/Waterford-Michigan/Building-Automation-Systems-SJMO.html, retrieved from internet Oct. 27, 2022 (2 pages).

Johnson Heating and Cooling L.L.C., "Waterford Internal Medicine Building Automation," URL: http://cooljohnson.com/Building-Automation-Systems-Michigan/Waterford-Michigan/Building-Automation-Systems-WIM.html, retrieved from internet Oct. 27, 2022 (3 pages).

Johnson Heating and Cooling, LLC, "Building Automation Clawson Michigan 2.0," URL: http://cooljohnson.com/Building-Automation-Systems-Michigan/Clawson-Michigan/Building-Automation-Clawson-Manor-2.html, retrieved from the internet Oct. 27, 2022 (6 pages).

Johnson Heating and Cooling, LLC, "Building Automation Images Clawson Michigan 2.0," URL: http://cooljohnson.com/Building-Automation-Systems-Michigan/Clawson-Michigan/Building-Automation-Clawson-Manor-2-Images.html, retrieved from the internet Oct. 27, 2022 (14 pages).

Johnson Heating and Cooling, LLC, "Building Automation System Clawson Michigan Clawson Manor," URL: http://cooljohnson.com/Building-Automation-Systems-Michigan/Clawson-Michigan/Building-Automation-System-Clawson-Manor.html; retrieved from the internet Oct. 27, 2022 (3 pages).

Johnson Heating and Cooling, LLC, "Building Automation System in Michigan Images," URL: http://cooljohnson.com/Building-Automation-Systems-Michigan/Macomb-County-Michigan/Building-Automation-Images.html; retrieved from the internet Oct. 27, 2022 (13 pages).

Johnson Heating and Cooling, LLC, "Building Automation System in Michigan," URL: http://cooljohnson.com/Building-Automation-Systems-Michigan/Macomb-County-Michigan/Building-Automation-Confidential-Customer.html; retrieved from the internet, Oct. 27, 2022 (4 pages).

Johnson Solid State LLC, "Building Automation Equipment," URL: http://cooljohnson.com/Video/Building_Automation/Confidential_Customer_BLD_2/Building_Automation_Equipment.mp4, retrieved from internet Oct. 27, 2022 (35 pages).

Johnson Solid State LLC, "Building Automation GUI," URL: http://cooljohnson.com/Video/Building_Automation/Confidential_Customer_BLD_2/Building_Automation_GUI.mp4, retrieved from internet Oct. 27, 2022 (24 pages).

Johnson Solid State LLC, "Cooling Logic Overview," URL: http://coolinglogic.com/documents/CoolingLogic_Overview_High_Quality.mp4, retrieved from internet Oct. 27, 2022 (16 pages).

(56) References Cited

OTHER PUBLICATIONS

Johnson Solid State LLC, "So what is CoolingLogic™?" URL: http://coolinglogic.com/Coolinglogic-How-it-Works.html, retrieved from the internet Oct. 27, 2022 (3 pages).
Johnson, David, "A Method to Increase HVAC System Efficiency And Decrease Energy Consumption," White Paper: Johnson Solid State, LLC, URL: http://coolinglogic.com/documents/16102106_White_Paper_High_Resolution_Protected.pdf, Sep. 24, 2016 (51 pages).
Johnson, David, "CoolingLogic™: Mosaic Christian Church A Case Study," Report: Johnson Solid State, LLC, URL: http://coolinglogic.com/documents/19020301_Mosaic_Christian_Coolinglogic_Case_Study.pdf, Feb. 2, 2019 (140 pages).
Johnson, David, "Excel Rehabilitation Building Automation: Building Automation System User Manual ," URL: http://cooljohnson.com/Building-Automation-Systems-Michigan/Waterford-Michigan/Building-Automation-System-Excel-Manual.html, 2012 (10 pages).
Johnson, David, "Temperature Control System and Methods for Operating Same," Pre-Publication printout of U.S. Appl. No. 15/231,943, filed Aug. 9, 2016, URL: http://coolinglogic.com/documents/16080901_CIP_As_Filed.pdf (99 pages).
Johnson, David., "CoolingLogic™: Changing the Way You Cool," Report: Johnson Solid State, LLC, URL: http://coolinglogic.com/documents/18111303_Changing_the_way_you_Cool.pdf, Nov. 7, 2018 (12 pages).

* cited by examiner

SYSTEMS AND METHODS FOR OPERATING A FURNACE SYSTEM

CROSS-REFERENCE TO RELATED APPLICATIONS

This application claims priority from and the benefit of U.S. Provisional Application No. 63/107,331, entitled "AIR INLET BLOCKAGE DETECTION," filed Oct. 29, 2020, which is hereby incorporated by reference in its entirety for all purposes.

BACKGROUND

This section is intended to introduce the reader to various aspects of art that may be related to various aspects of the present disclosure and are described below. This discussion is believed to be helpful in providing the reader with background information to facilitate a better understanding of the various aspects of the present disclosure. Accordingly, it should be noted that these statements are to be read in this light, and not as admissions of prior art.

Heating, ventilation, and/or air conditioning (HVAC) systems are utilized in residential, commercial, and industrial environments to control environmental properties, such as temperature and humidity, for occupants of the respective environments. An HVAC system may control the environmental properties through control of a supply air flow delivered to the environment. For example, the HVAC system may place the supply air flow in a heat exchange relationship with a refrigerant of a vapor compression circuit to condition the supply air flow. The HVAC system may include a furnace system configured to heat the supply air flow. For instance, the furnace system may include a burner assembly configured to receive and ignite a fuel to produce heated combustion byproducts that are used to provide heat to the supply air flow. During operation of the furnace system, the burner assembly may not operate desirably or efficiently and may impact performance of the furnace system. However, it may be difficult to monitor the operation of the burner assembly to determine and therefore address an undesirable or inefficient operation of the burner assembly.

SUMMARY

A summary of certain embodiments disclosed herein is set forth below. It should be noted that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, a furnace system includes a heat exchanger and a burner assembly including a burner enclosure fluidly coupled to the heat exchanger. The burner assembly is configured to receive a fluid, ignite the fluid to produce combustion byproducts, and direct the combustion byproducts to the heat exchanger. The furnace system also includes a pressure sensor configured to detect a pressure within the burner enclosure. The furnace system is configured to operate based on the pressure detected by the pressure sensor.

In one embodiment, a furnace system includes a burner enclosure configured to receive a fuel/oxidizer mixture and ignite the fuel/oxidizer mixture to produce combustion byproducts and a pressure sensor disposed within the burner enclosure. The pressure sensor is configured to detect a pressure within the burner enclosure, and the pressure sensor is configured to cause interruption of a flow of electrical power to the furnace system to suspend operation of the furnace system in response to the pressure having a vacuum that exceeds a threshold negative pressure.

In one embodiment, a burner assembly of a furnace system includes a burner enclosure with an internal volume and configured to receive a fuel and ignite the fuel to produce combustion byproducts. The burner assembly also includes a pressure switch fluidly coupled to the internal volume. The pressure switch is configured to transition between a closed configuration and an open configuration, the closed configuration enables flow of electrical power to the furnace system, the open configuration interrupts the flow of electrical power to the furnace system, and the pressure switch is configured to adjust to the open configuration in response to a vacuum within the burner enclosure exceeding a threshold pressure.

BRIEF DESCRIPTION OF THE DRAWINGS

Various aspects of this disclosure may be better understood upon reading the following detailed description and upon reference to the drawings in which.

DETAILED DESCRIPTION

Figure 1:
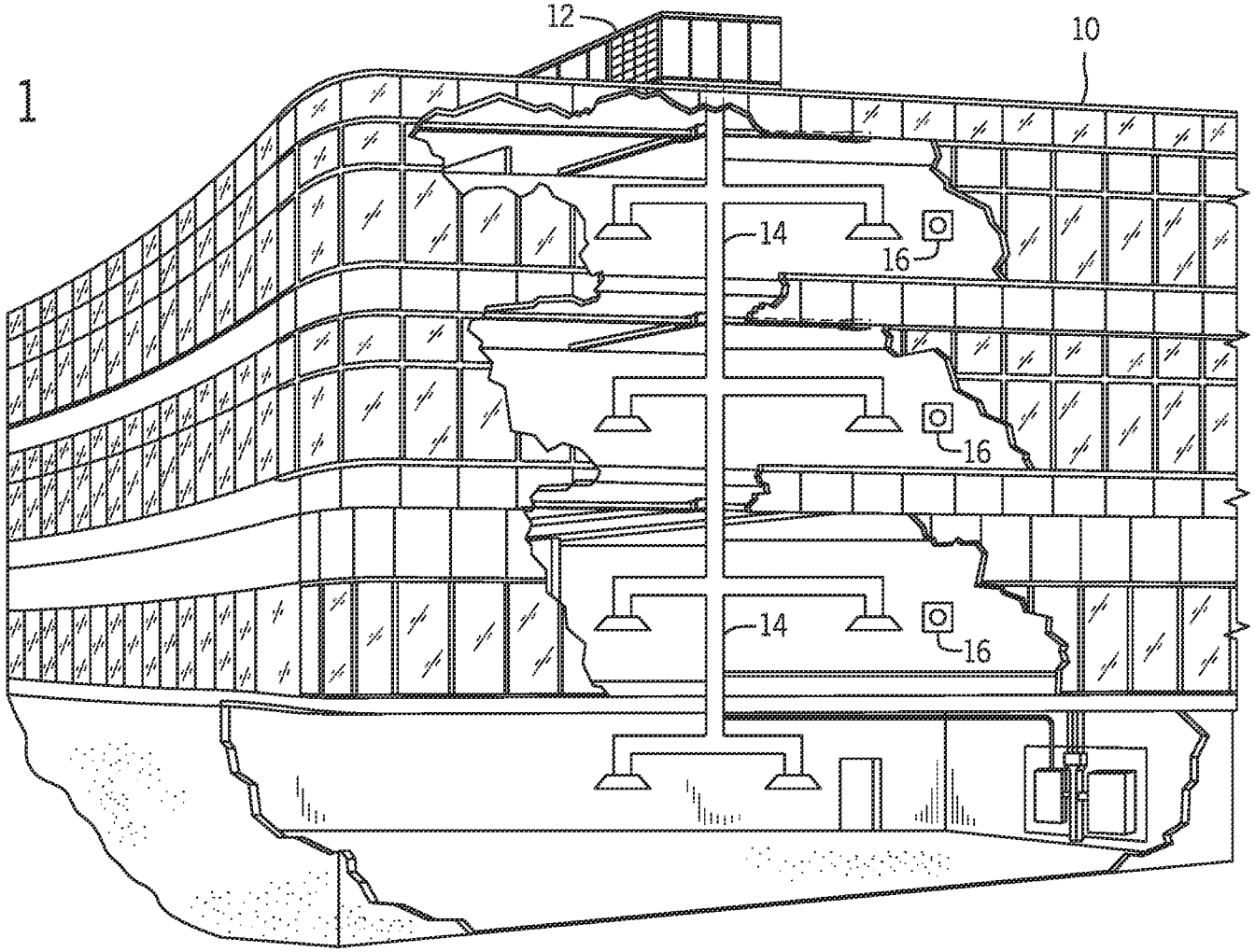
FIG. 1 is a perspective view of an embodiment of a heating, ventilation, and/or air conditioning (HVAC) system for environmental management that may employ one or more HVAC units, in accordance with an aspect of the present disclosure.

One or more specific embodiments will be described below. In an effort to provide a concise description of these embodiments, not all features of an actual implementation are described in the specification. It should be noted that in the development of any such actual implementation, as in any engineering or design project, numerous implementation-specific decisions must be made to achieve the developers' specific goals, such as compliance with system-related and business-related constraints, which may vary from one implementation to another. Moreover, it should be noted that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be noted that references to "one embodiment" or "an embodiment" of the present disclosure are not intended to be interpreted as excluding the existence of additional embodiments that also incorporate the recited features.

The present disclosure is directed to a heating, ventilation, and/or air conditioning (HVAC) system. The HVAC system may include a furnace system configured to heat a supply air flow. For example, the furnace system may include a burner assembly that has a burner enclosure. During operation of the furnace system, the burner enclosure may be configured to receive a fluid (e.g., a fuel/oxidizer mixture) and ignite the fluid to produce combustion byproducts, which may be directed through a heat exchanger of the furnace system. The supply air flow may be directed across the heat exchanger, and the heat exchanger may transfer heat from the combustion byproducts to the supply air flow, thereby heating the supply air flow.

In some circumstances, the burner assembly may not operate desirably or efficiently. For example, there may be a blockage within a conduit fluidly coupled to the burner enclosure (e.g., an inlet of the burner enclosure). The blockage may impact operation of the burner assembly. For instance, the conduit may direct a fuel/oxidizer mixture into the burner enclosure during operation of the burner assembly for ignition to generate the combustion byproducts. The conduit may also facilitate cooling of the burner enclosure between operations of the burner assembly. By way of example, the conduit may facilitate flow of the combustion byproducts and/or another air flow out of the burner enclosure while the fuel/oxidizer mixture is not being ignited. The blockage in the conduit may restrict or limit flow rate of the fuel/oxidizer mixture into the burner enclosure, thereby affecting a desirable or efficient operation of the burner assembly. The blockage may additionally or alternatively block desirable cooling of the burner enclosure between operations of the burner assembly, thereby causing potential overheating of the burner enclosure. Indeed, the blockage may impart an undesirable amount of stress on the furnace system to heat the supply air flow and/or reduce an efficiency associated with operating the furnace system.

Thus, it is presently recognized that monitoring an operating parameter indicative of a blockage into and/or within the burner assembly may provide benefits to improve functionality of a furnace system, such as to address an undesirable and/or inefficient operation of the burner assembly. Accordingly, embodiments of the present disclosure are directed to a system and method configured to determine whether there is a blockage occurring in the burner assembly. By way of example, the blockage may restrict flow of air, a fuel/oxidizer mixture, and/or combustion products between an interior of the burner enclosure and an exterior of the burner enclosure, thereby causing an undesirable pressure imbalance between the interior and the exterior of the burner enclosure. For instance, during operation of the burner assembly, such as to satisfy a call for heating, air may be directed through the burner enclosure to direct the combustion byproducts from the burner enclosure to the heat exchanger. Directing the air through the burner enclosure may reduce a pressure within the burner enclosure to create a negative or vacuum pressure within the burner enclosure (e.g., an expected vacuum or negative pressure). However, during occurrence of a blockage of air flow into and/or out of the burner enclosure, the negative or vacuum pressure within the burner enclosure may become increasingly negative, which may adversely affect operation of the burner assembly. That is, operation of the burner enclosure while the blockage is present may increase the vacuum within the burner enclosure beyond a desirable pressure level. Thus, it is presently recognized that a sufficiently negative pressure level, such as a vacuum exceeding a threshold vacuum pressure (e.g., a threshold negative pressure), may indicate a blockage of air flow into and/or out of the burner enclosure. Thus, in accordance with present embodiments, operation of the furnace system may be suspended and/or otherwise adjusted in response to detection of a vacuum exceeding the threshold pressure (e.g., the negative pressure within the burner enclosure is too great) in order to enable the blockage to be addressed.

In some embodiments, the furnace system may include a pressure switch configured to enable or block flow of electrical power to a component of the furnace system based on the pressure detected within the burner enclosure. For instance, the pressure indicating that a vacuum within the burner enclosure exceeds the threshold vacuum pressure may cause the pressure switch to interrupt the flow of electrical power and therefore suspend operation of the furnace system. In additional or alternative embodiments, the furnace system may include a control system configured to receive data indicative of the pressure within the burner enclosure. The control system may determine whether the pressure indicates a vacuum exceeds the threshold pressure and output a control signal to suspend operation of the furnace system in response to a determination that the pressure indicates a vacuum that exceeds the threshold pressure. For example, the control signal output by the control system may interrupt the flow of electrical power to the furnace system to suspend operation of the furnace system. Thus, an undesirable operation of the furnace system during a blockage may be avoided.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
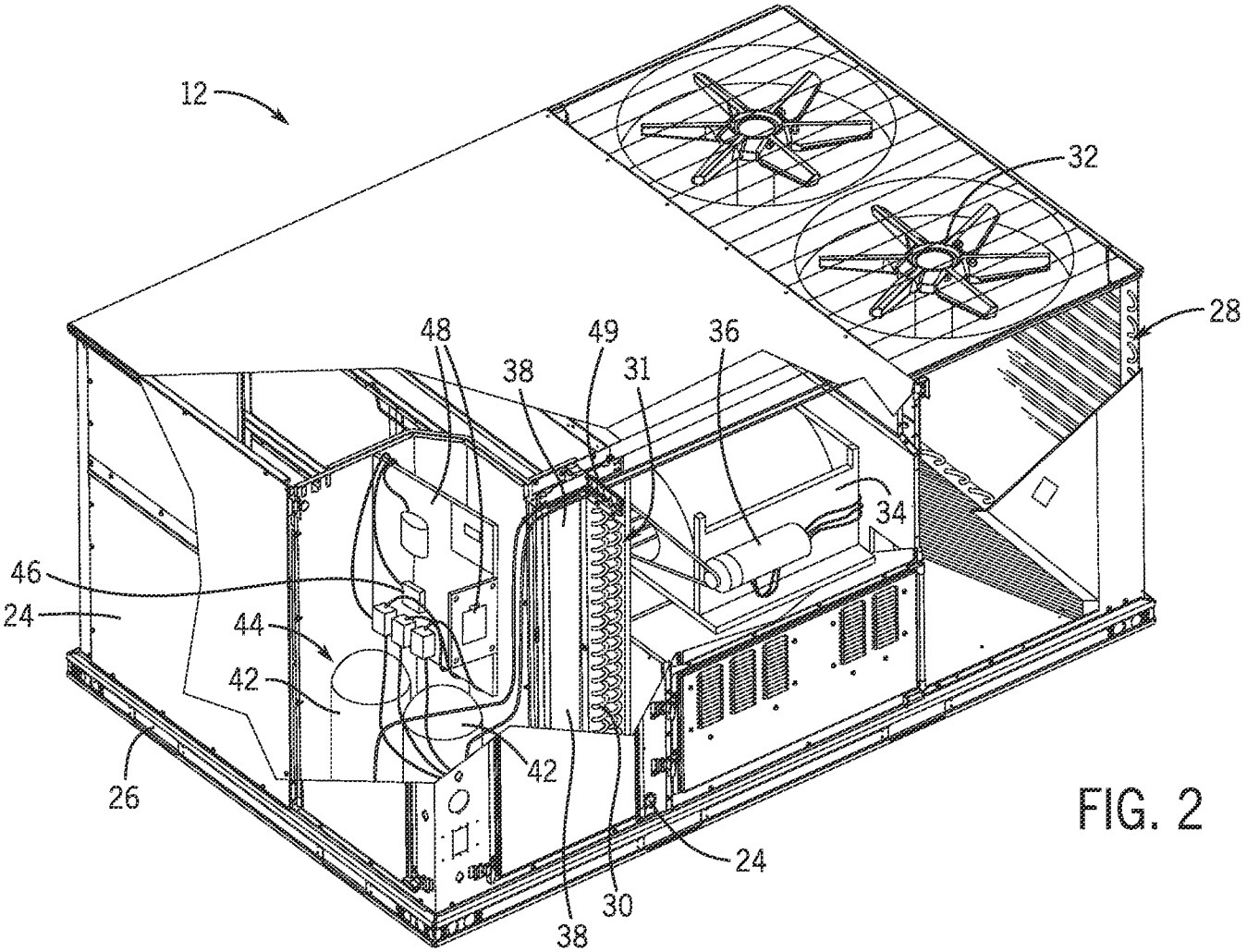
FIG. 2 is a perspective view of an embodiment of a packaged HVAC unit that may be used in the HVAC system of FIG. 1, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit onto "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. Additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
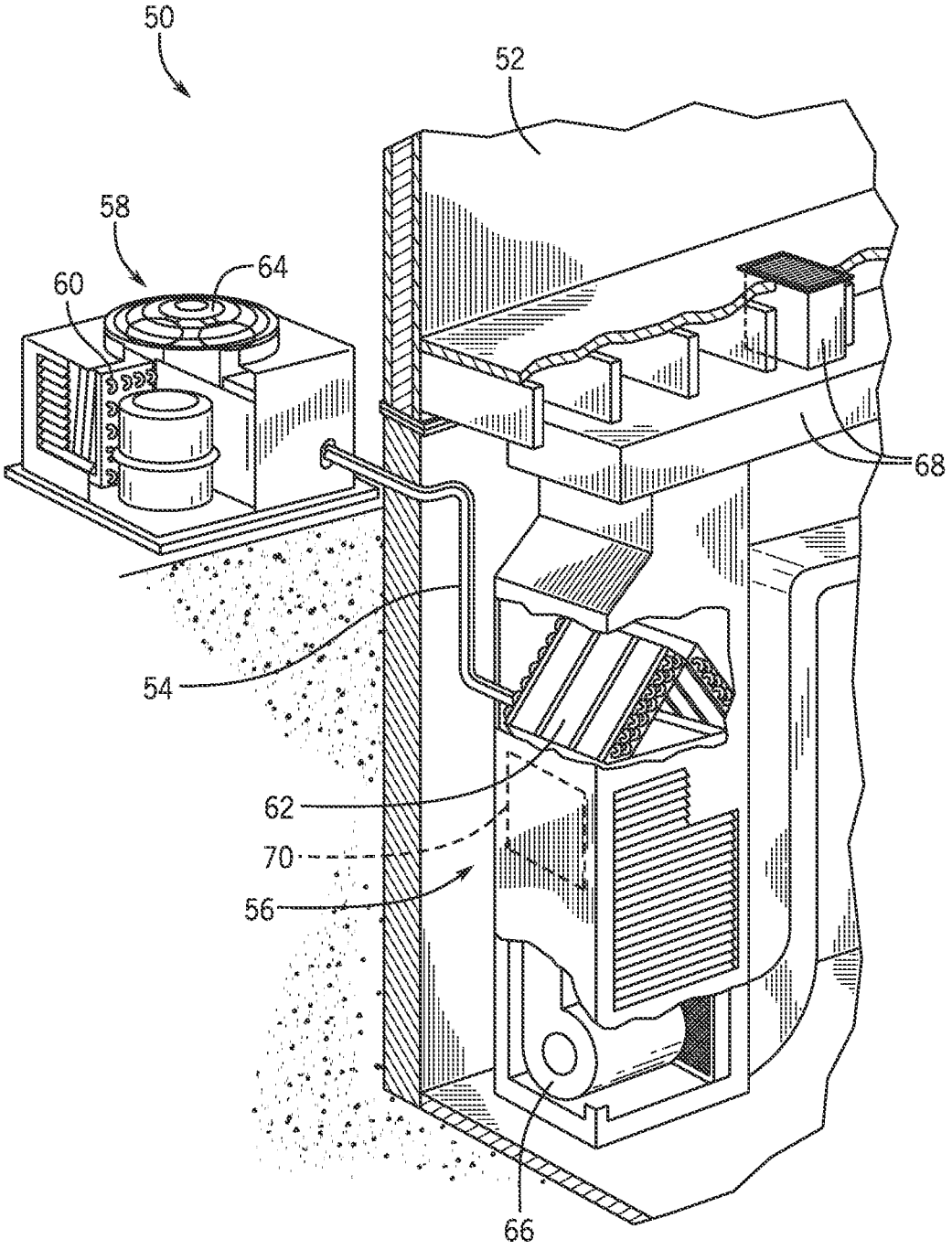
FIG. 3 is a cutaway perspective view of an embodiment of a residential, split HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over the outdoor heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
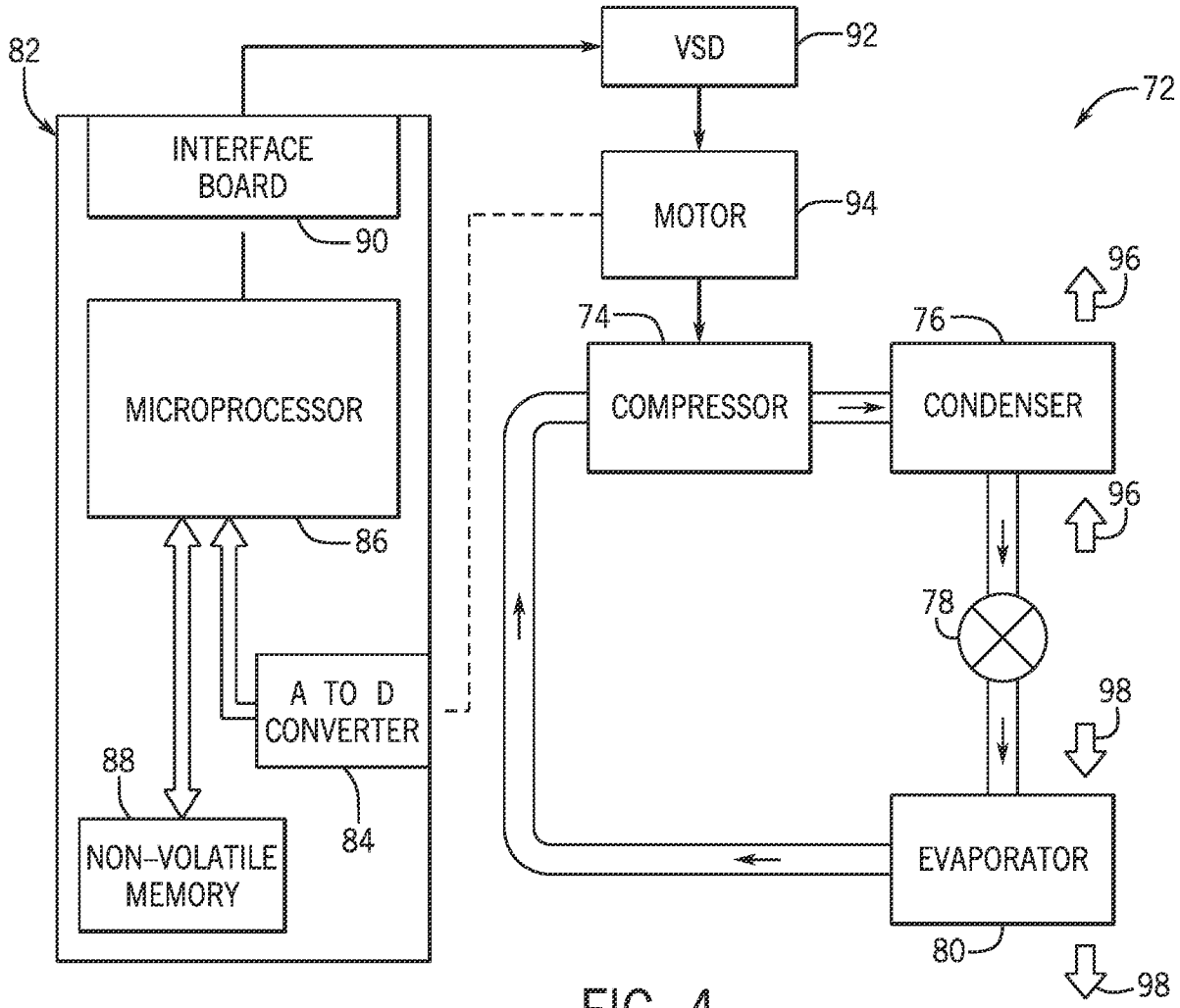
FIG. 4 is a schematic diagram of an embodiment of a vapor compression system that can be used in any of the systems of FIGS. 1-3, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

Any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

The present disclosure is directed to a furnace system of an HVAC system. The furnace system may include a burner assembly having a burner enclosure configured to receive a fluid, such as a fuel/oxidizer mixture, and ignite the fluid to produce combustion byproducts. The furnace system may also include a pressure sensor configured to detect a pressure (e.g., a negative pressure, a vacuum) within the burner enclosure. In response to a determination that the pressure indicates a vacuum within the burner enclosure exceeds a threshold pressure (e.g., a threshold negative pressure), operation of the furnace system may be suspended or otherwise adjusted. For example, flow of electrical power to the furnace system may be interrupted to suspend operation of the furnace system. In some embodiments, the pressure sensor may include a pressure switch, and the vacuum exceeding the threshold pressure may cause the pressure switch to open to interrupt the flow of electrical power. In additional or alternative embodiments, a control system may be communicatively coupled to the pressure sensor. The control system may be configured to receive data from the pressure sensor indicative of the vacuum within the burner enclosure, and the control system may be configured to output a control signal to interrupt the flow of electrical power in response to the vacuum exceeding the threshold pressure as indicated by the data. Thus, the furnace system may be blocked from operating undesirably during a blockage of air flow into and/or out of the burner enclosure. Although the present disclosure primarily describes the furnace system of a split HVAC system, the techniques described herein may be incorporated in any suitable furnace system, such as a furnace system of an HVAC unit and/or a standalone furnace system.

Figure 5:
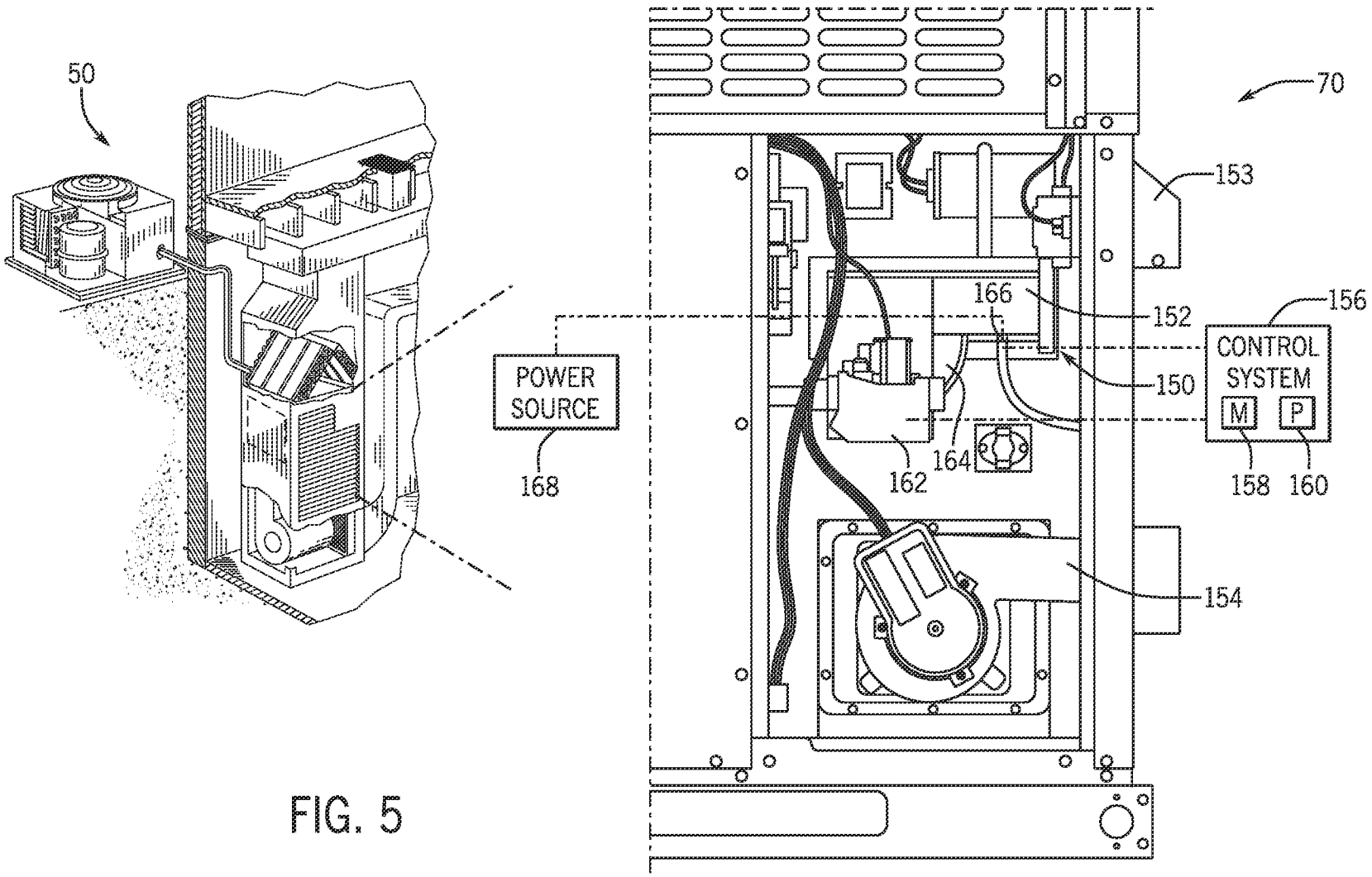
FIG. 5 is a detailed view of an embodiment of a furnace system, in accordance with an aspect of the present disclosure.

With this in mind, FIG. 5 is a detailed view of the furnace system 70 of the residential heating and cooling system 50. The furnace system 70 may include a burner assembly 150 configured to provide heat for the furnace system 70. For example, the burner assembly 150 may include a burner enclosure, housing, or box 152, which may be configured to receive a fuel (e.g., natural gas). In some embodiments, the burner assembly 150 may be a premix burner assembly in which the burner enclosure 152 may also configured to receive an oxidizer, such as an air flow (e.g., ambient air via an air intake 153), and the oxidizer and the fuel may combine to form a fuel/oxidizer mixture. The burner enclosure 152 may be configured to ignite the fuel/oxidizer mixture (e.g., via a pilot light, an electric igniter, a hot surface igniter) to produce a flame and generate combustion byproducts within the burner enclosure 152. By way of example, a desirable composition of the fuel/oxidizer mixture may be maintained, such as by controlling a flow rate of the oxidizer into the burner enclosure 152 (e.g., via an opening of the air intake 153) and/or a flow rate of the fuel into the burner enclosure 152. The desirable composition of the fuel/oxidizer mixture may enable desirable and/or efficient operation of the burner assembly 150, such as to produce a flame having a sufficient temperature via the fuel/oxidizer mixture.

The burner enclosure 152 may be fluidly coupled to a heat exchanger (not shown) of the furnace system 70, and the furnace system 70 may include a blower 154 (e.g., a draft inducer blower) configured to draw an air flow through the burner enclosure 152 to direct the combustion byproducts from the burner enclosure 152 through the heat exchanger. Additionally, a fan (e.g., the fan 66) may direct an air flow across the heat exchanger, and heat from the combustion byproducts flowing through the heat exchanger may transfer to the air flow directed across the heat exchanger, thereby heating the air flow. The heated air flow may then be directed to a space serviced by the furnace system 70 to heat the space.

The furnace system 70 may also include a control system 156 (e.g., an automation controller, a programmable controller) configured to operate the furnace system 70. The control system 156 may include a memory 158 and processing circuitry 160. The memory 158 may include a non-transitory computer-readable medium that may include volatile memory, such as random-access memory (RAM), and/or non-volatile memory, such as read-only memory (ROM), flash memory, optical drives, hard disc drives, solid-state drives, or any other suitable non-transitory computer-readable medium storing instructions that, when executed by the processing circuitry 160, may control operation of the furnace system 70. To this end, the processing circuitry 160 may include one or more application specific integrated circuits (ASICs), one or more field programmable gate arrays (FPGAs), one or more programmable logic devices (PLD), one or more programmable logic arrays (PLA), one or more general purpose processors, or any combination thereof configured to execute such instructions. For example, the control system 156 may be configured to receive a call for heating. In response, the control system 156 may be configured to adjust a valve 162 to direct the fuel/oxidizer mixture into the burner enclosure 152 via a conduit 164 (e.g., a conduit 164 fluidly coupled to the air intake 153) to enable the burner assembly 150 to provide heat for the air flow directed through the furnace system 70 and satisfy the call for heating.

In some circumstances, there may be a blockage in the conduit 164 (e.g., at the air intake 153) that impacts an operation of the burner assembly 150. For example, the blockage may be caused by debris (e.g., dirt, foliage) lodged or accumulated within the conduit 164 and/or a change in geometry of the conduit 164. The blockage may adversely impact operation of the furnace system 70. For example, a blockage may increase an amount of stress imparted on the components of the furnace system 70, reduce an efficient operation of the burner assembly 150, inhibit the production of a flame of desired quality or characteristics, and so forth. In some instances, the blockage may reduce a flow of the oxidizer, the fuel, and/or the fuel/oxidizer mixture into the burner enclosure 152. By way of example, the blockage may adjust the composition of the fuel/oxidizer mixture and cause an undesirable operation of the burner assembly 150, such as an inadequate ignition of the fuel/oxidizer mixture and/or generation of a flame having an insufficient temperature. The blockage may additionally or alternatively reduce a flow rate of combustion products between an interior of the burner enclosure 152 and an exterior of the burner enclosure 152 to reduce an efficiency of the heat exchanger to heat the air flow. Further still, the blockage may reduce cooling of the burner enclosure 152 (e.g., between operating cycles of the furnace system) to cause the burner enclosure 152 to overheat, thereby imparting an excessive amount of stress and/or affecting a structural integrity of the burner enclosure 152. In each of these examples, the furnace system 70 may operate inefficiently and/or undesirably. Therefore, it may be desirable to suspend operation of the furnace system 70 during a blockage within the conduit 164 in order to enable a user (e.g., a technician, an operator, a customer) to address the blockage.

For this reason, the burner assembly 150 may include a pressure sensor 166 configured to detect a pressure within the burner enclosure 152. As an example, the pressure may include a negative or vacuum pressure and/or a pressure differential between a first pressure within the burner enclosure 152 relative to a second pressure external to the burner enclosure 152. A blockage of the conduit 164 may cause an increased negative pressure (e.g., a pressure that is more negative) and/or an increased pressure differential. Thus, the pressure sensor 166 may be used to determine whether a blockage is present and/or provide an indication that a blockage may be present. For example, a detected vacuum that exceeds a threshold pressure (e.g., a threshold negative pressure) may indicate a presence of a blockage.

In some embodiments, the pressure sensor 166 may include a pressure switch configured to control electricity supplied to operate the furnace system 70. For example, the furnace system 70 may include or be electrically coupled to a power source 168 configured to supply electrical power to a component (e.g., the control system 156, a motor of the blower 154, the valve 162) of the furnace system 70. The component may receive the electrical power from the power source 168 to operate and enable operation of the furnace system 70. The pressure sensor 166 may be configured to interrupt the electrical power supplied from the power source 168 in response to detection of a pressure indicative of a blockage within the conduit 164. By way of example, the pressure sensor 166 may include and/or be connected to a normally closed switch and may enable flow of electrical power from the power source 168 to the component of the furnace system 70 while a vacuum within the burner enclosure 152 is less than a threshold pressure. However, in response to the vacuum exceeding the threshold pressure to indicate a blockage within the conduit 164, the pressure sensor 166 and/or switch may open and interrupt the flow of electrical power from the power source 168 to the component of the furnace system 70. Indeed, the vacuum may impart a force onto the pressure sensor 166, and the vacuum exceeding the threshold pressure may physically cause the pressure sensor 166 and/or switch to open. Thus, the pressure sensor 166 may open and/or close automatically, such as without receipt of a control signal. The opening of the pressure sensor 166 to interrupt flow of electrical power from the power source 168 may suspend operation of the furnace system 70.

In additional or alternative embodiments, the pressure sensor 166 may be communicatively coupled to the control system 156, and the control system 156 may receive data from the pressure sensor 166. The data may indicate the pressure within the burner enclosure 152 determined by the pressure sensor 166, and the control system 156 may be configured to determine whether the data received from the pressure sensor 166 is indicative of a blockage within the conduit 164. As an example, the control system 156 may be configured to compare a vacuum pressure value (e.g., a negative pressure value) indicated by the data to the threshold pressure (e.g., a threshold negative pressure value). In response to the vacuum pressure value exceeding (e.g., being more negative than) the threshold pressure, the control system 156 may be configured to transmit a control signal to suspend operation of the furnace system 70. For example, the control system 156 may interrupt flow of electrical power from the power source 168 and/or block flow of the fuel/oxidizer mixture into the burner enclosure 152 (e.g., via the valve 162), thereby blocking operation of the burner assembly 150 in response to a call for heating. The control system 156 may further be configured to perform another action in response to the vacuum exceeding the threshold pressure. For instance, the control system 156 may be configured to output a notification, such as a message to a mobile device (e.g., a mobile phone, a tablet, a computer), a visual output (e.g., a light), and/or an audio output (e.g., a sound), to indicate the determination of the blockage within the conduit 164. Thus, the control system 156 may prompt a user to address the blockage.

The furnace system 70 may be configured to operate in different operating modes, such as different stages, to heat the air flow. The pressure within the burner enclosure 152 may vary for the different operating modes. However, in certain embodiments, the threshold pressure to which the pressure detected by the pressure sensor 166 is compared, may be fixed at a common value or may be the same value in each of the different operating modes of the furnace system 70. For example, to avoid suspending operation of the furnace system 70 when there is no blockage within the conduit 164 in such embodiments, the threshold pressure may be set at a substantially high enough value such that, in the absence of a blockage within the conduit 164, the vacuum within the burner enclosure 152 does not exceed the threshold pressure regardless of the operating mode of the furnace system 70. Alternatively, the threshold pressure may change for different operating modes of the furnace system 70. That is, a respective, dedicated threshold pressure may be set for each of the operating modes, and each threshold pressure may be indicative of a blockage within the conduit 164 for the corresponding operating mode. As such, a threshold pressure may be selected based on the operating mode effectuated during operation of the furnace system 70. In either case, the threshold pressure may be set based on a geometry or size of the burner enclosure 152, a parameter (e.g., a rated speed) of the blower 154, a capacity of the furnace system 70, another suitable parameter related to the furnace system 70, or any combination thereof. By way of example, the threshold pressure may be set prior to installation or operation of the furnace system 70, such as during design, manufacture, and/or testing of the furnace system 70.

The pressure monitored by the pressure sensor 166 may accurately and/or reliably indicate whether there is a blockage within the conduit 164 and/or whether the burner assembly 150 is operating desirably. By way of example, certain other operating parameters, such as temperature, may fluctuate based on various conditions, such as a condition (e.g., temperature) of an ambient environment, that are not directly associated with operation (e.g., proper operation) of the furnace system 70. Thus, such operating parameters may not accurately and/or reliably indicate the presence of a blockage within the conduit 164. However, the pressure within the burner enclosure 152 may not be substantially affected by such operating parameters. For example, the pressure within the burner enclosure 152 may primarily depend on an open volume and/or flow path within the conduit 164, which may not sufficiently fluctuate absent a blockage of the volume or flow path. Therefore, an undesirable and/or substantial change of pressure within the burner enclosure 152 may indicate an undesirable operation of the furnace system 70, such as a blockage within the conduit 164.

Figure 6:
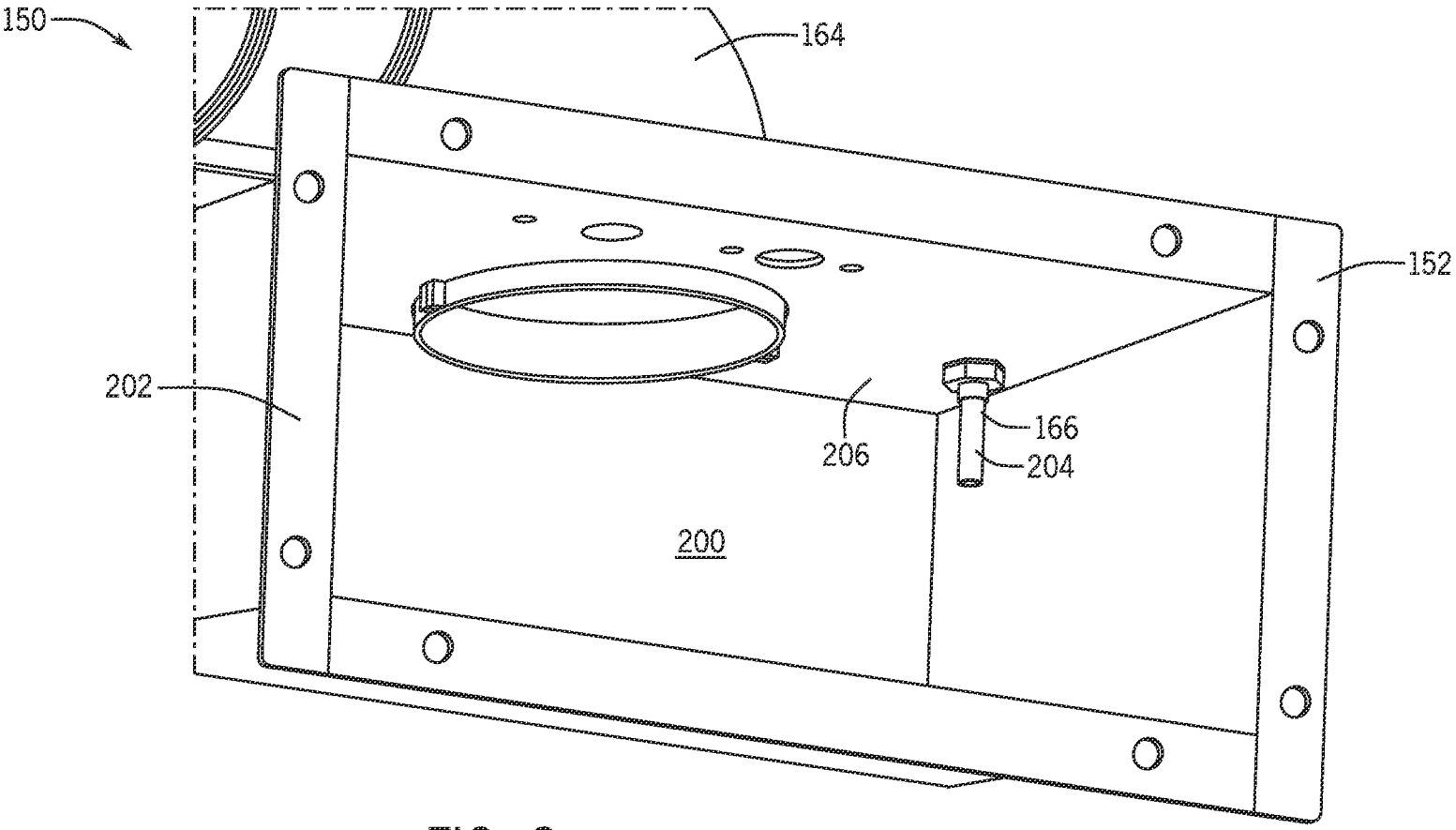
FIG. 6 is a perspective view of an embodiment of a burner assembly of a furnace system, in accordance with an aspect of the present disclosure.

FIG. 6 is a perspective view of an embodiment of the burner assembly 150. The burner enclosure 152 of the burner assembly 150 may form an internal volume 200 configured to receive a fuel/oxidizer mixture via the conduit 164. The fuel/oxidizer mixture may be ignited within the internal volume 200 to produce the combustion byproducts. The internal volume 200 may be fluidly coupled to a heat exchanger to enable the combustion byproducts to be directed through the heat exchanger, such as through tubing of the heat exchanger. As an example, the burner enclosure 152 may include flanges 202 configured to couple to (e.g., secure to, mount to) the heat exchanger to enable the combustion byproducts to flow from the internal volume 200 into the heat exchanger, such as via a blower drawing or forcing an air flow from the internal volume 200 through the heat exchanger, to enable the heat exchanger to provide heat to an air flow directed across the heat exchanger.

A first end 204 (e.g., an internal end, a distal end) of the pressure sensor 166 may extend within the internal volume 200 of the burner enclosure 152 in order to monitor a pressure within the burner enclosure 152. In the illustrated embodiment, the pressure sensor 166 is positioned at or coupled to (e.g., extends through) a common panel 206 of the burner enclosure 152 at which the conduit 164 is positioned. However, the pressure sensor 166 and the conduit 164 may be positioned at different panels or sides of the burner enclosure 152 in additional or alternative embodiments. For example, the pressure sensor 166 may be positioned at a panel adjacent to the panel 206 and/or across from the panel 206. Indeed, although the illustrated burner enclosure 152 has a rectangular geometry, the burner enclosure 152 may have any suitable geometry, such as a cylindrical or round geometry, and the pressure sensor 166 may be positioned at any suitable location of the burner enclosure 152.

The pressure sensor 166 may also be arranged to avoid impacting operation of the burner assembly 150. For example, the first end 204 may terminate prior to a location where the fuel/oxidizer mixture is ignited (e.g., where a flame is produced) to produce the combustion byproducts. Such arrangement of the pressure sensor 166 may also block a condition within the burner enclosure 152 from impacting the pressure sensor 166. For instance, the temperature where the pressure sensor 166 is positioned may be substantially cooler than the temperature where the fuel/oxidizer mixture is ignited. Thus, ignition of the fuel/oxidizer mixture, which increases the temperature within the burner enclosure 152, may not affect accuracy and/or reliability of the pressure sensor 166, a longevity of the pressure sensor 166, a positioning of the pressure sensor 166, and so forth.

Figure 7:
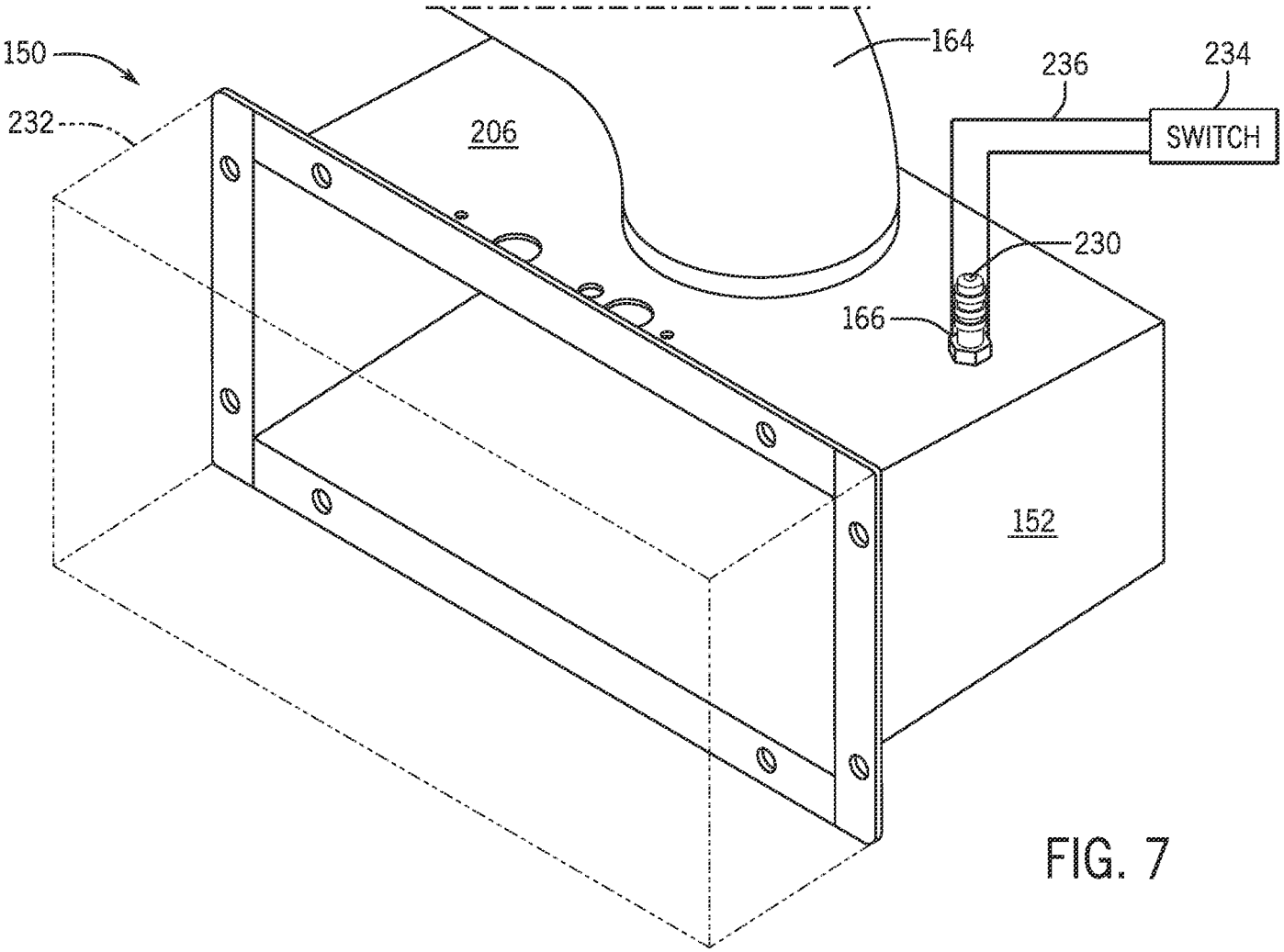
FIG. 7 is a perspective view of an embodiment of a burner assembly of a furnace system, in accordance with an aspect of the present disclosure.

FIG. 7 is a perspective view of an embodiment of the burner assembly 150. In the illustrated embodiment, a second end 230 (e.g., an external end) of the pressure sensor 166 extends externally to the burner enclosure 152. For example, the pressure sensor 166 may extend through the panel 206 such that the first end 204 of the pressure sensor 166 is positioned within the internal volume 200 and the second end 230 is positioned external to the internal volume 200. In embodiments in which the pressure sensor 166 includes a pressure switch, the second end 230 may be electrically coupled to the power source 168 and may control flow of electrical power from the power source 168 to the furnace system 70 based on whether the pressure sensor 166 is in the open configuration or the closed configuration. In response to the pressure determined by the pressure sensor 166 indicating a vacuum that exceeds the threshold pressure, the pressure sensor 166 may open to interrupt flow of the electrical power from the power source 168 to the furnace system 70, thereby suspending operation of the furnace system 70. As an example, the pressure sensor 166 may open and interrupt flow of electrical power to a motor of the blower 154, thereby suspending operation of the blower 154 and blocking combustion byproducts from being directed through a heat exchanger to heat an air flow. As another example, the pressure sensor 166 may open and interrupt flow of electrical power to the valve 162 and cause the valve 162 to block flow of the fuel/air mixture into the burner enclosure 152, thereby blocking ignition of the fuel/air mixture and generation of the combustion byproducts within the burner enclosure 152 for heating the air flow.

In embodiments in which the control system 156 may operate the furnace system 70 based on the pressure detected by the pressure sensor 166, the second end 230 may be communicatively coupled to the control system 156 in order to communicatively couple the pressure sensor 166 and the control system 156 to one another. In this manner, the second end 230 may enable the pressure sensor 166 to transmit data indicative of a pressure within the burner enclosure 152 to the control system 156 to enable the control system 156 to operate based on the data.

The illustrated burner enclosure 152 is coupled to (e.g., secured to, mounted to) a heat exchanger 232. Thus, during operation of the burner assembly 150, combustion byproducts produced via ignition of a fuel/oxidizer mixture within the burner enclosure 152 may be directed through the heat exchanger 232 to heat an air flow. However, suspending operation of the furnace system 70 may block ignition of the fuel/oxidizer mixture within the burner enclosure 152 and/or flow of the combustion byproducts through the heat exchanger 232. Thus, the heat exchanger 232 may not heat the air flow while operation of the furnace system 70 is suspended.

Although the pressure sensor 166 extends into the burner enclosure 152 in each of the embodiments depicted in FIGS. 6 and 7, in additional or alternative embodiments, the pressure sensor 166 may extend into the conduit 164 and/or the air intake 153. By way of example, the pressure sensor 166 may be configured to detect a pressure within the conduit 164 and/or the air intake 153 in addition to or as alternative to the pressure within the burner enclosure 152. In further embodiments, the pressure sensor 166 may extend into the heat exchanger 232 (e.g., an inlet of the heat exchanger 232). Thus, the pressure sensor 166 may be configured to detect a pressure within the heat exchanger 232 for controlling operation of the furnace system 70 in accordance with the present techniques.

In further embodiments, the pressure sensor 166 may include an assembly having an external pressure switch 234 that is not directly mounted to or attached to the burner enclosure 152. For example, in such embodiments, the pressure sensor 166 may include a pressure tap (e.g., an opening, a hole, an aperture) formed through the burner enclosure 152 and a pressure hose, conduit, or tube 236 fluidly coupling the burner enclosure 152 to the external pressure switch 234 via the pressure tap. The pressure hose 236 may be configured to direct air between the external pressure switch 234 and the burner enclosure 152, thereby transmitting the pressure (e.g., air pressure, fluid pressure) within the burner enclosure 152 to the external pressure switch 234. Thus, the external pressure switch 234 may be configured to monitor the pressure within the burner enclosure 152 via the pressure hose 236. The external pressure switch 234 may be electrically coupled to the power source 168, and the vacuum within the burner enclosure 152 exceeding the threshold pressure may cause the external pressure switch 234 to open and interrupt flow of electrical power from the power source 168 to the furnace system 70. As such, the external pressure switch 234 may be configured to suspend operation of the furnace system 70 based on detection of a pressure or pressure differential indicative of a blockage within the furnace system 70.

Figure 8:
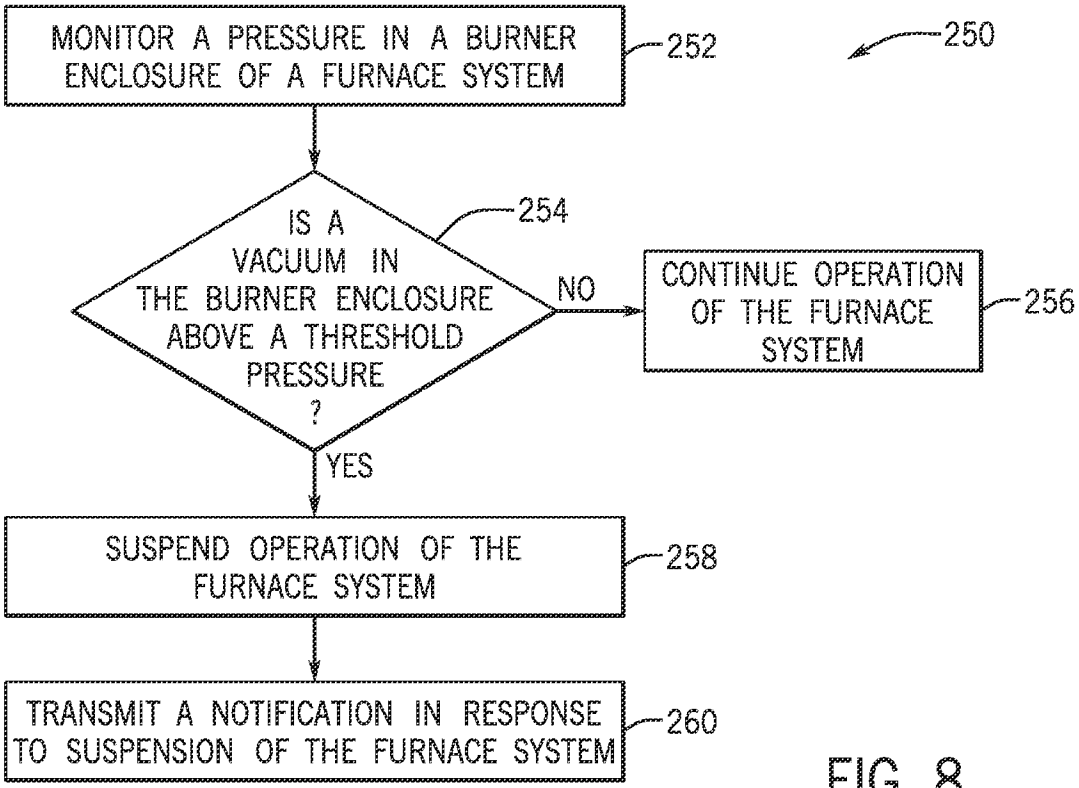
FIG. 8 is a flowchart of an embodiment of a method or process for operating a furnace system, in accordance with an aspect of the present disclosure.

FIG. 8 is a flowchart of an embodiment of a method or process 250 for operating the furnace system 70. In some embodiments, the method 250 and/or one or more of the steps thereof may be performed by a single respective component or system, such as by the control system 156 (e.g., the processing circuitry 160). In additional or alternative embodiments, multiple components or systems may perform the steps for the method 250. It should also be noted that additional steps may be performed with respect to the method 250. Moreover, certain steps of the method 250 may be removed, modified, and/or performed in a different order.

At block 252, a pressure within the burner enclosure 152 may be monitored. By way of example, the pressure sensor 166 may detect the pressure within the burner enclosure 152 and transmit data indicative of the pressure (e.g., a vacuum pressure value). At block 254, a determination is made regarding whether the pressure indicates that a vacuum in the burner enclosure 152 exceeds a threshold pressure (e.g., a threshold negative pressure), which may be previously determined based on a condition and/or design of the furnace system 70. At block 256, in response to a determination that the vacuum is above the threshold pressure, which may indicate absence of a blockage in the furnace system 70 (e.g., within the conduit 164), operation of the furnace system 70 may be continued or may not be interrupted. As an example, flow of electrical power from the power source 168 to the furnace system 70 may remain enabled to provide power to components of the furnace system 70, thereby enabling operation of the furnace system 70.

However, at block 258, in response to a determination that the vacuum within the burner enclosure 152 is above the threshold pressure, operation of the furnace system 70 may be suspended. For instance, the flow of electrical power from the power source 168 to the furnace system 70, such as to a motor, the valve 162, and/or the control system 156, may be interrupted, thereby suspending operation of the furnace system 70. For example, the interruption of the flow of electrical power to the furnace system 70 may block the furnace system 70 from igniting a fuel/oxidizer mixture, generating combustion byproducts, and/or directing combustion byproducts to a heat exchanger. As such, the furnace system 70 may not heat an air flow while the flow of electrical power is interrupted. In some embodiments, at block 260, in response to an interruption of electrical power to the furnace system 70, a notification may be transmitted to indicate the suspension of operation of the furnace system 70. The notification may prompt a user to address the operation of the furnace system 70, such as to mitigate or remove a blockage within the conduit 164 or other portion of the furnace system 70. In certain embodiments, the notification (e.g., a visual output, an audio output) may be continually transmitted, such as at a set frequency, while the operation of the furnace system 70 is suspended to inform the user of the suspended operation of the furnace system 70.

It should be noted that the method 250 may continually be performed during operation of the furnace system 70. That is, the pressure within the burner enclosure 152 may be repeatedly detected, and the vacuum associated with the pressure may be repeatedly compared to the threshold pressure to determine whether operation of the furnace system 70 may be continued. At any time in which the pressure indicates a vacuum within the burner enclosure 152 exceeding the threshold pressure, the operation of the furnace system 70 may be suspended. At such time, the operation of the furnace system 70 may not be re-initiated until the excessive vacuum within the burner enclosure 152 is addressed, such as to unblock the conduit 164. Thus, the furnace system 70 may be blocked from initiating or continuing an undesirable operation.

In embodiments in which the pressure sensor 166 includes a pressure switch, one or more steps of the method 250 may be automatically performed without a control signal. That is, the pressure within the burner enclosure 152 may automatically (e.g., physically) adjust the pressure sensor 166 between a closed configuration and an open configuration without receipt of a control signal (e.g., from the control system 156). Indeed, in some embodiments, the pressure sensor 166 may be a normally closed switch that remains in the closed configuration to enable flow of electrical power from the power source 168 to the furnace system 70, thereby enabling operation of the furnace system 70, and the vacuum exceeding the threshold pressure may drive the pressure sensor 166 (e.g., switch) to switch to the open configuration to interrupt flow of electrical power to the furnace system 70, thereby suspending operation of the furnace system 70. In alternative embodiments, the pressure sensor 166 may normally be in the open configuration to interrupt flow of electric power to the furnace system 70. In such embodiments, the vacuum being below the threshold pressure may drive the pressure sensor 166 to the closed configuration to enable flow of electrical power to the furnace system 70 and enable operation of the furnace system 70. The vacuum exceeding the threshold pressure may adjust the pressure sensor 166 to the open configuration to interrupt the flow of electrical power to the furnace system 70 and suspend operation of the furnace system 70. In such embodiments, the step described with respect to block 254 regarding determining whether the vacuum exceeds the threshold pressure may not be performed. Rather, the pressure within the burner enclosure 152 may physically adjust the configuration of the pressure sensor 166 to enable or block flow of electrical power to the furnace system 70 without having to perform a comparison between the vacuum and the threshold pressure. Furthermore, in such embodiments, the control system 156 may continue to operate while the operation of the furnace system 70 is suspended. For example, the control system 156 may be configured to transmit a notification even though the flow of electrical power to the furnace system 70 is interrupted.

In embodiments in which one or more steps of the method 250 may be performed by the control system 156 communicatively coupled to the pressure sensor 166, one or more steps of the method 250 may be performed by one or more control signals output by the control system 156. For example, the control system 156 may output a control signal to suspend operation of the furnace system 70 (e.g., by interrupting flow of electrical power to the furnace system 70). Further, in certain embodiments of performing the method 250 via the pressure sensor 166 and/or via the control system 156, the method 250 may be performed automatically without a user input. In additional or alternative embodiments, the method 250 may be performed in response to a user input, which may indicate a request to monitor the pressure within the burner enclosure 152.

The present disclosure may provide one or more technical effects useful in the operation of an HVAC system. For example, the HVAC system may include a furnace system configured to heat a supply air flow. The furnace system may include a burner assembly configured to provide heat. For instance, the burner assembly may include a premix burner assembly having a burner enclosure configured to receive a fuel/oxidizer mixture and ignite the fuel/oxidizer mixture to produce combustion byproducts. The combustion byproducts may be directed to a heat exchanger, and the supply air flow may be directed across the heat exchanger to enable heat transfer from the combustion byproducts to the supply air flow. The heated supply air flow may be directed to a space to heat the space. A pressure (e.g., a negative pressure) within the burner enclosure may be detected to determine whether the burner enclosure is operating desirably. By way of example, in response to the pressure indicating a vacuum exceeding a threshold pressure (e.g., a threshold negative pressure), the operation of the furnace system may be suspended to enable the undesirable operation of the furnace system to be addressed.

In some embodiments, the furnace system may include a pressure switch configured to adjust between a closed configuration to enable flow of electrical power to operate the furnace system and an open configuration to interrupt the flow of electrical power and suspend operation of the furnace system. As an example, an excessive vacuum pressure within the burner assembly may physically drive the pressure switch to the open configuration, thereby interrupting the flow of electrical power and suspending operation of the furnace system. In additional or alternative embodiments, a control system may be configured to receive data (e.g., from a pressure sensor) indicative of the pressure within the burner enclosure. The control system may compare a vacuum indicated by the pressure to the threshold pressure. In response to a determination that the vacuum exceeds the threshold pressure, the control system may output a control signal to suspend operation of the furnace system, such as a control signal to interrupt flow of electrical power to the furnace system. As such, the furnace system may be blocked from continued undesirable operation. The technical effects and technical problems in the specification are examples and are not limiting. It should be noted that the embodiments described in the specification may have other technical effects and can solve other technical problems.

While only certain features and embodiments of the disclosure have been illustrated and described, many modifications and changes may occur to those skilled in the art, such as variations in sizes, dimensions, structures, shapes and proportions of the various elements, values of parameters, including temperatures and pressures, mounting arrangements, use of materials, colors, orientations, and so forth without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode of carrying out the disclosure, or those unrelated to enabling the claimed disclosure. It should be noted that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A furnace system, comprising:

a heat exchanger;

a conduit configured to direct a fuel/oxidizer mixture therethrough;

a burner assembly comprising a burner enclosure fluidly coupled to the heat exchanger and the conduit and disposed between the heat exchanger and the conduit, wherein the burner enclosure is configured to receive the fuel/oxidizer mixture from the conduit, ignite the fuel/oxidizer mixture to produce combustion byproducts, and direct the combustion byproducts to the heat exchanger; and a pressure sensor disposed within the burner enclosure and configured to detect a negative pressure within the burner enclosure, wherein the furnace system is configured to adjust operation based on a determination that the negative pressure detected by the pressure sensor exceeds a threshold negative pressure, wherein the determination is indicative of a blockage within the conduit.

2. The furnace system of claim 1, comprising a controller communicatively coupled to the pressure sensor, wherein the controller is configured to:

receive data from the pressure sensor, wherein the data is indicative of the negative pressure within the burner enclosure; and suspend operation of the furnace system in response to the determination that the negative pressure exceeds the threshold negative pressure.

3. The furnace system of claim 2, wherein the controller is configured to interrupt a flow of electrical power to suspend operation of the furnace system in response to the determination that the negative pressure exceeds the threshold negative pressure.

4. The furnace system of claim 2, comprising a valve configured to adjust a flow rate of the fuel/oxidizer mixture directed into the burner enclosure, wherein the controller is configured to adjust the valve to adjust operation of the furnace system.

5. The furnace system of claim 1, wherein the furnace system is configured to operate in an operating mode of a plurality of operating modes of the furnace system, wherein each operating mode of the plurality of operating modes is associated with a corresponding threshold pressure value.

6. A furnace system, comprising:

a premix burner assembly, comprising:

a conduit configured to direct a fuel/oxidizer mixture therethrough;

a burner enclosure configured to receive the fuel/oxidizer mixture from the conduit and ignite the fuel/oxidizer mixture to produce combustion byproducts; and a pressure sensor comprising a first end positioned within an internal volume of the burner enclosure and a second end positioned external to the internal volume, wherein the pressure sensor is configured to detect a pressure within the burner enclosure, and the pressure sensor is configured to cause interruption of a flow of electrical power to the furnace system to suspend operation of the furnace system in response to the pressure comprising a vacuum that exceeds a threshold negative pressure indicative of a blockage within the conduit.

7. The furnace system of claim 6, wherein the pressure sensor comprises a pressure switch, and the pressure switch is configured to interrupt the flow of electrical power to the furnace system in response to the vacuum exceeding the threshold negative pressure.

8. The furnace system of claim 7, wherein the pressure switch is a normally closed pressure switch configured to transition from a closed configuration to an open configuration to interrupt the flow of electrical power to the furnace system in response to the vacuum exceeding the threshold negative pressure.

9. The furnace system of claim 6, comprising a controller configured to:

receive data indicative of a vacuum pressure value within the burner enclosure from the pressure sensor;

compare the vacuum pressure value to the threshold negative pressure; and interrupt the flow of electrical power to the furnace system in response to the vacuum pressure value exceeding the threshold negative pressure.

10. The furnace system of claim 6, wherein the pressure sensor is configured to cause the interruption of the flow of electrical power to a motor of the furnace system, a valve of the furnace system, a controller of the furnace system, or any combination thereof.

11. The furnace system of claim 6, wherein the conduit and the pressure sensor extend through a common panel of the burner enclosure.

12. A burner assembly of a furnace system, the burner assembly comprising:

a burner enclosure comprising an internal volume, wherein the burner enclosure is configured to receive a fuel/oxidizer mixture from a conduit coupled to the burner enclosure and ignite the fuel/oxidizer mixture to produce combustion byproducts; and a pressure switch comprising a first end positioned within an internal volume of the burner enclosure and a second end positioned external to the internal volume, wherein the pressure switch is configured to transition between a closed configuration and an open configuration, wherein the closed configuration enables flow of electrical power to the furnace system, the open configuration interrupts the flow of electrical power to the furnace system, and the pressure switch is configured to adjust to the open configuration in response to a detection of a vacuum within the burner enclosure exceeding a threshold negative pressure, wherein the detection is indicative of a blockage within the conduit.

13. The burner assembly of claim 12, wherein the pressure switch is normally in the closed configuration.

14. The burner assembly of claim 12, wherein the burner enclosure is fluidly coupled to a heat exchanger of the furnace system and is configured to direct the combustion byproducts from the internal volume to the heat exchanger during operation of the furnace system.

15. The burner assembly of claim 12, wherein the pressure switch, in the open configuration, is configured to interrupt the flow of electrical power to a controller of the furnace system.

* * * * *